US010975596B2

(12) United States Patent
Lin

(10) Patent No.: US 10,975,596 B2
(45) Date of Patent: Apr. 13, 2021

(54) AUTO-LATCHING LATCH ASSEMBLY

(71) Applicant: I-TEK METAL MFG. CO., LTD, Tainan (TW)

(72) Inventor: Hsi-Ting Lin, Tainan (TW)

(73) Assignee: I-TEK METAL MFG. CO., LTD, Tainan (TW)

( * ) Notice: Subject to any disclaimer, the term of this patent is extended or adjusted under 35 U.S.C. 154(b) by 406 days.

(21) Appl. No.: 15/683,855

(22) Filed: Aug. 23, 2017

(65) Prior Publication Data

US 2019/0032366 A1 Jan. 31, 2019

(30) Foreign Application Priority Data

Jul. 25, 2017 (TW) ..... 10621088.1

(51) Int. Cl.

| | |
|---|---|
| ***E05B 17/20*** | (2006.01) |
| ***E05B 63/20*** | (2006.01) |
| ***E05B 15/16*** | (2006.01) |
| ***E05C 7/06*** | (2006.01) |
| ***E05B 65/10*** | (2006.01) |
| *E05C 7/04* | (2006.01) |

(52) U.S. Cl.

CPC ..... *E05B 17/2007* (2013.01); *E05B 15/1635* (2013.01); *E05B 63/20* (2013.01); *E05B 65/104* (2013.01); *E05C 7/06* (2013.01); *E05B 17/2038* (2013.01); *E05C 7/045* (2013.01)

(58) Field of Classification Search

CPC ..... E05B 15/1635; E05B 15/0046; E05B 67/383; E05B 63/20; E05B 65/1013; E05B 65/202; E05B 65/104; E05B 17/2038; E05B 63/202; E05B 17/2007; E05B 17/2015; E05B 15/0086; E05B 2015/1642; E05B 2015/0046; E05C 7/06; E05C 7/045; E05C 2063/207

USPC ..... 292/138

See application file for complete search history.

(56) References Cited

U.S. PATENT DOCUMENTS

| | | | | | |
|---|---|---|---|---|---|
| 3,705,739 | A * | 12/1972 | Adler | E05B 65/104 | 292/92 |
| 4,012,066 | A * | 3/1977 | Salvatore | E05B 65/104 | 292/341.13 |
| 4,183,565 | A * | 1/1980 | Allemann | E05B 65/104 | 292/150 |
| 4,362,328 | A * | 12/1982 | Tacheny | E05C 9/043 | 292/36 |
| 6,945,571 | B2 * | 9/2005 | Lin | E05B 65/1013 | 292/156 |

(Continued)

*Primary Examiner* — Nathan Cumar

(74) *Attorney, Agent, or Firm* — Alan D. Kamrath; Karin L. Williams; Mayer & Williams PC

(57) ABSTRACT

An auto-latching latch assembly is mounted to a follower door of a double door. The latch assembly includes a latch movable between an unlatching position and a latching position and a movable member jointly movable with the latch. A positioning member is jointly pivotable with the movable member. When the latch moves to the unlatching position, the positioning member positions the latch in the unlatching position. When the follower door is closed while a primary door of the double door is closed, an actuation latch presses against and releases the positioning member to move the latch to the latching position, reliably locking the follower door.

4 Claims, 13 Drawing Sheets

(56) References Cited

U.S. PATENT DOCUMENTS

| | | | | |
|---|---|---|---|---|
| 6,955,378 | B2 * | 10/2005 | Schlack | E05C 3/06 292/232 |
| 7,707,862 | B2 * | 5/2010 | Walls | E05C 9/20 292/156 |
| 7,788,954 | B2 * | 9/2010 | Schumm | E05B 53/005 292/41 |
| 8,286,917 | B2 * | 10/2012 | Erickson | B64D 11/0023 244/131 |
| 9,567,782 | B2 * | 2/2017 | Raatikainen | E05C 7/06 |
| 2009/0019779 | A1 * | 1/2009 | Nakanishi | E05B 63/185 49/449 |

* cited by examiner

AUTO-LATCHING LATCH ASSEMBLY

BACKGROUND OF THE INVENTION

The present invention relates to an auto-latching latch assembly and, more particularly, to an auto-latching latch assembly installed in a follower door of a double door for locking when the follower door is closed.

A double door generally includes a primary door and a follower door pivotably mounted to a door frame. A lock is mounted to the primary door and includes a handle on a side of the primary door and a latch on an end face of the primary door. The latch can be retracted into the primary door upon pivotal movement of the handle. A latch assembly mounted to an upper end of the follower door is referred to as a top latch assembly. A latch assembly mounted to a lower end of the follower door is referred to as a bottom latch assembly. Although there are no obstacles for the upper end of the follower door in the pivotal path thereof, the ground is located beneath the lower end of the follower door, such that the structure of the top latch assembly is generally different from the structure of the bottom latch assembly. Specifically, a latch of the top latch assembly can still be in the latching position (because there are no obstacles) even though the follower door is not in the closed position. When the follower door is pivoted to the closed position, the door frame can press against a slant face of the latch of the top latch assembly to move this latch to the retracted, latching position until the follower door reaches the closed position. When the follower door is in the closed position, the latch of the top latch assembly is not pressed by the door frame and is biased by a spring to the latching position engaged with a receptacle in the door frame.

However, if the follower door is not in the closed position and the latch of the bottom latch assembly is not in the latching position, the friction between the latch of the bottom latch assembly and the ground adversely affects the pivotal movement of the follower door. As a result, the bottom latch assembly is so designed that the latch of the bottom latch assembly cannot be in the latching position when the follower door is not in the closed position. Consequently, the manufacturers have to design two latch assemblies having different structures to respectively serve as the top latch assembly and the bottom latch assembly, resulting in an increase in the production costs.

BRIEF SUMMARY OF THE INVENTION

A latch assembly according to the present invention includes a base having an activity space. The base further includes a first engagement hole, a second engagement hole, and a third engagement hole. The base further includes an actuating slot. A first pin extends through the first engagement hole of the base. A second pin extends through the second engagement hole of the base. A third pin extends through the third engagement hole of the base. A movable member is slideably received in the activity space of the base. The movable member includes a first sliding groove slideably receiving the first pin and a second sliding groove slideably receiving the second pin. The movable member is movable between an engagement position and a disengagement position along a first axis. The movable member further includes an actuating groove received in the actuating slot and is configured to move the movable member between the engagement position and the disengagement position. A latch is jointly movable with the movable member and is movable between a latching position and an unlatching position along the first axis. The latch is in the unlatching position when the movable member is in the disengagement position. The latch is in the latching position when the movable member is in the engagement position. A limiting frame is fixed on the base and is located adjacent to the third pin. The limiting frame includes a slot. An actuation latch is movably received in the limiting frame. The actuation latch is movable between a releasing position and a pressing position along a second axis perpendicular to the first axis. A positioning member is pivotably connected to the movable member and includes an engagement arm.

When the movable member is in the disengagement position, the positioning member is spaced from the third pin along the first axis. When the movable member moves from the disengagement position to the engagement position and the actuation latch is in the releasing position, the engagement arm of the positioning member engages with the third pin, such that the movable member is located in the disengagement position and such that the latch is located in the unlatching position.

When the engagement arm of the positioning member engages with the third pin and the actuation latch moves from the releasing position to the pressing position, the actuation latch pushes the positioning member to disengage the engagement arm from the third pin, such that the movable member moves to the engagement position and such that the latch moves to the latching position.

In an example, the engagement arm of the positioning member further includes a slant face corresponding to the third pin and an engagement notch adjacent to the slant face. When the movable member moves from the engagement position to the disengagement position, the third pin presses against the slant face of the positioning member, such that the positioning member pivots relative to the movable member. When the movable member is in the disengagement position, the engagement notch of the engagement arm of the positioning member engages with the third pin.

In an example, the latch assembly further includes a safety device jointly moveable with the movable member. The safety device includes a first sleeve and a second sleeve coupled to the first sleeve. The first sleeve includes a receiving hole. The safety device further includes a first stop mounted in the receiving hole of the safety device and a first safety pin coupled with the first stop. The safety device further includes a spring mounted in the receiving hole and biasing the first safety pin. The base further includes a coupling hole intercommunicated with the activity space. The positioning member further includes a pivotal portion pivotably connected to the safety device. The engagement arm of the positioning member extends from a side of the pivotal portion of the positioning member. When the movable member is in the disengagement position, the first safety pin of the safety device is misaligned from the coupling hole of the base. When the movable member is in the engagement position, the first safety pin of the safety device is aligned with the coupling hole of the base. When the first safety pin is aligned with the coupling hole of the base and does not melt, the first safety pin does not engage with the coupling hole of the base, and the movable member is movable between the disengagement position and the engagement position. When the first safety pin is aligned with the coupling hole of the base and melts, the first safety pin engages with the coupling hole of the base, and the movable member is prevented from moving from the disengagement position to the engagement position.

In an example, the latch assembly further includes a restraining member jointly movable with the movable member. The restraining member includes a slot. The positioning member further includes a protrusion extending from the pivotal portion and spaced from the engagement arm. A first spring is mounted in the restraining member. The first spring includes an end abutting the second pin and biases the movable member toward the engagement position. A torsion spring is mounted around the safety device and biases the positioning member to an initial position. When the positioning member is in the initial position, the protrusion of the positioning member abuts an inner wall of the slot of the restraining member. When the movable member moves from the engagement position to the disengagement position, the third pin presses against the engagement arm of the positioning member, such that the positioning member twists the torsion spring from the initial position.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
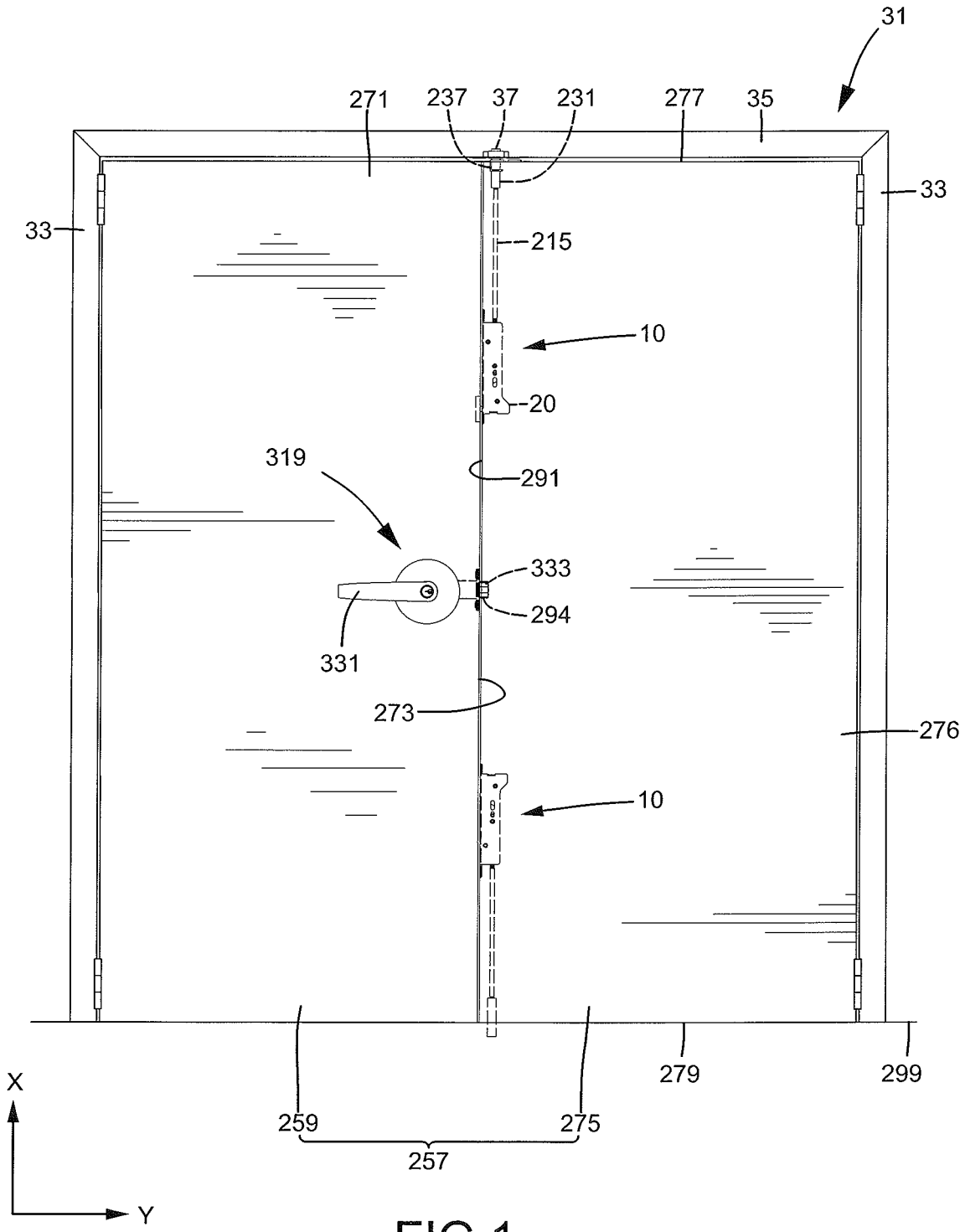
FIG. 1 is a diagrammatic front view of a double door to which two latch assemblies according to the present invention are mounted.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "top", "bottom", "inner", "outer", "end", "portion", "section", "vertical", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 4:
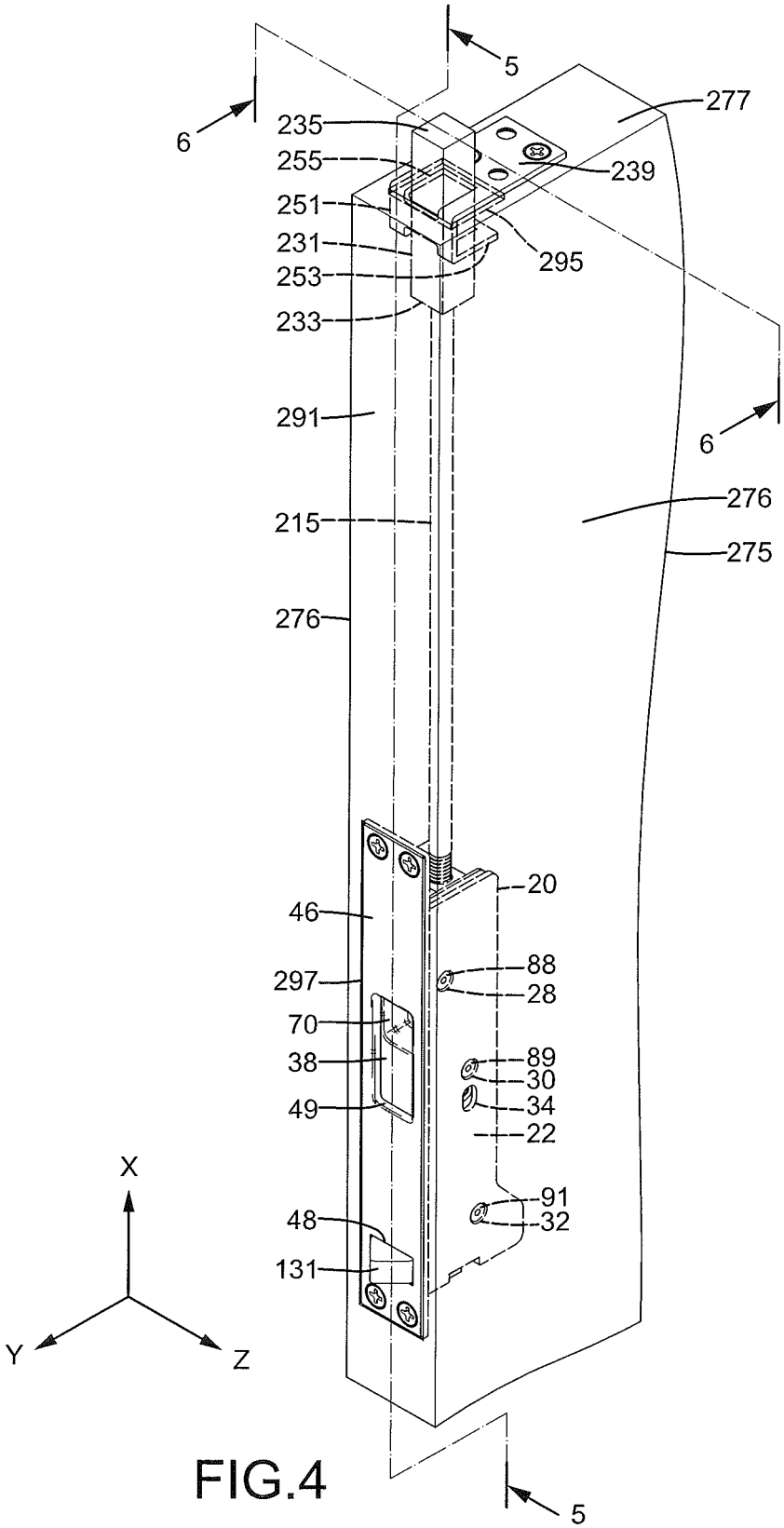
FIG. 4 is a partial, perspective view of the double door of FIG. 1.
Figure 11:
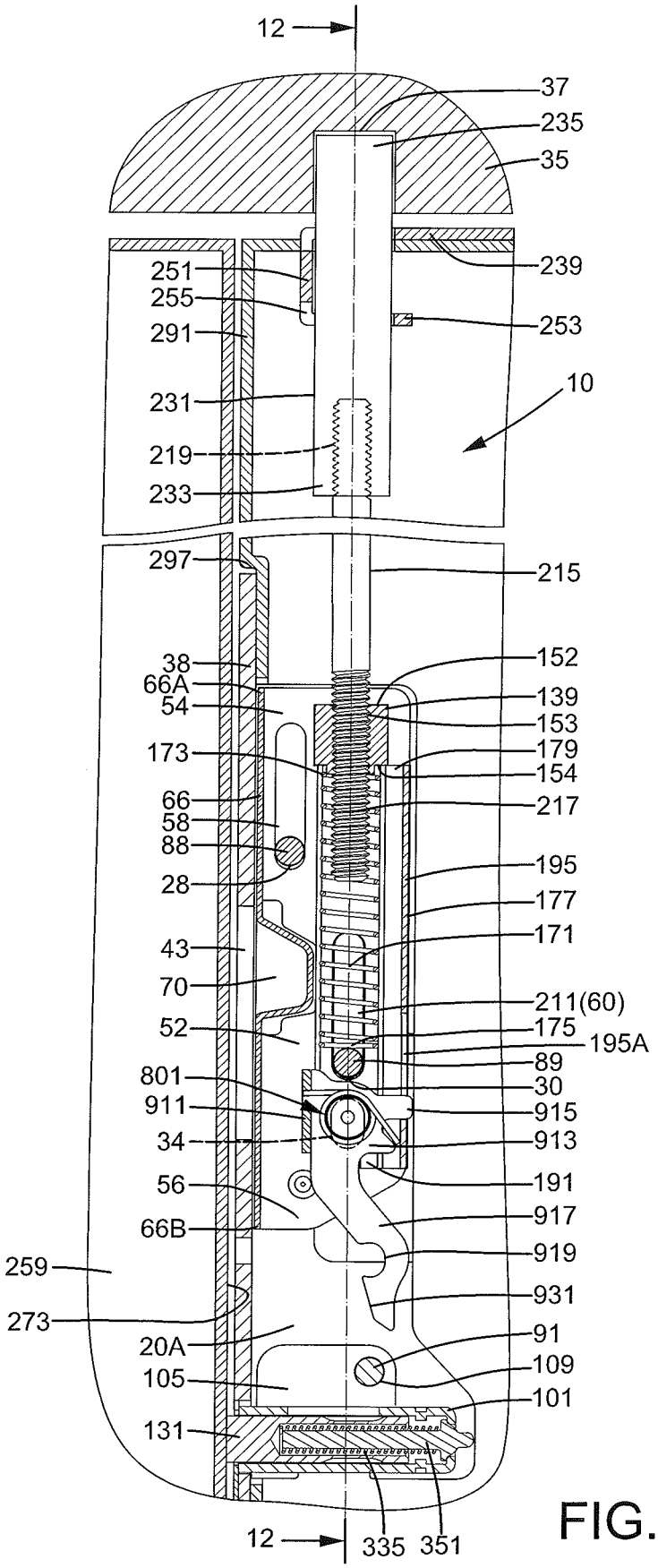
FIG. 11 is a view similar to FIG. 10, with the primary door in a closed position, and with a latch in a latching position.

A latch assembly 10 according to the present invention can be mounted to a double door 257. Double door 257 is mounted to a door frame 31 on a floor or the ground 299. Door frame 31 includes two spaced vertical beams 33 extending along a first axis X perpendicular to ground 299 and a top beam 35 extending between upper ends of vertical beams 33 along a second axis Y perpendicular to first axis X. Top beam 35 includes a groove 37. Double door 257 includes a primary door 259 pivotably mounted to one of vertical beams 33 and a follower door 275 pivotably mounted to the other vertical beam 33. Follower door 275 includes an interior space 293. Primary door 259 includes two sides 271 and an end face 273 extending between sides 271 and extending perpendicularly to ground 299. Follower door 275 includes two sides 276, a top face 277 extending between sides 276 and facing top beam 35, and a bottom face 279 extending between sides 276 and facing ground 299. Top face 277 includes a mounting hole 295 in communication with interior space 293. Follower door 275 further includes an end face 291 extending between sides 276 and between top and bottom faces 277 and 279. An engagement hole 297 and a receptacle 294 are defined in end face 291 (FIG. 4). Follower door 275 is pivotable about first axis X perpendicular to ground 299 between an open position (FIG. 9) and a closed position (FIG. 11). When follower door 275 is in the open position, mounting hole 295 is not aligned with groove 37. When follower door 275 is in the closed position, mounting hole 295 is aligned with groove 37.

Figure 5:
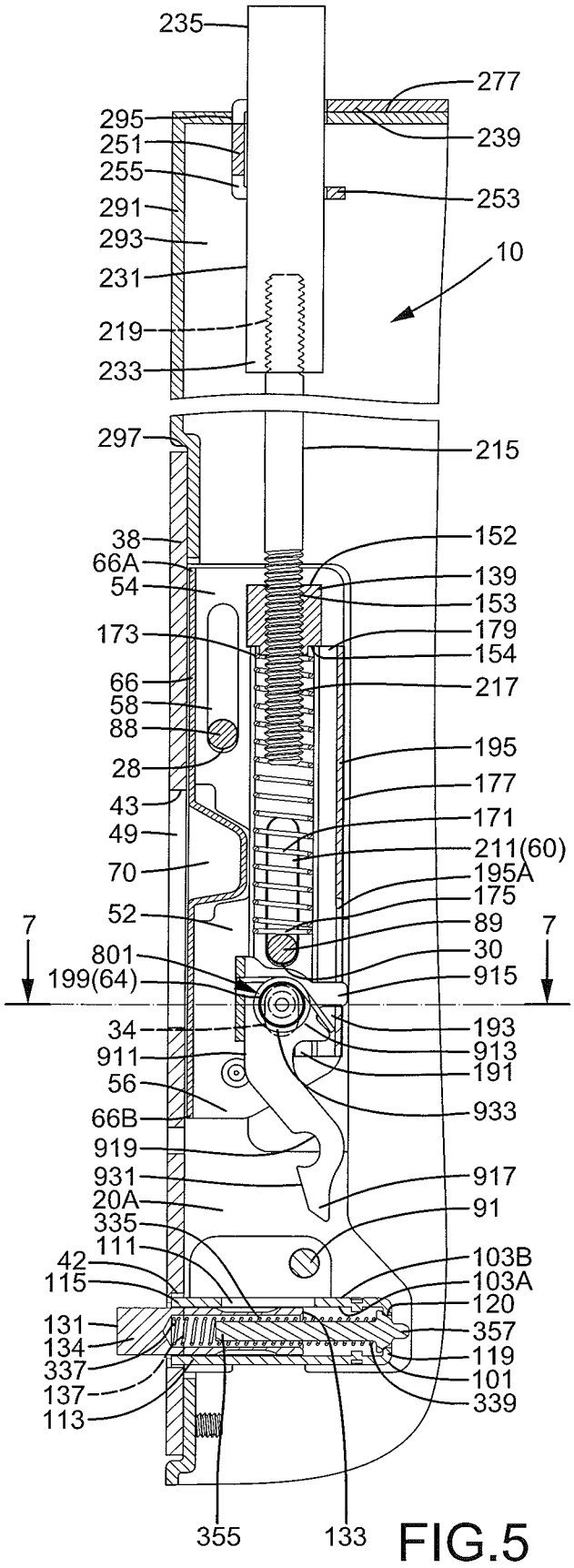
FIG. 5 is a cross sectional view taken along section line 5-5 of FIG. 4.

A door lock 319 is mounted to primary door 259. Door lock 319 can be of any desired form as conventional including but not limited to of a commercially available type. Door lock 319 includes a latch 333 and a handle 331 operatively connected to latch 333. Handle 331 is located on one of sides 271 of primary door 259. Pivotal movement of handle 331 causes movement of latch 333 from an extended position outside of end face 273 of primary door 259 to a retracted position inside of primary door 259. When follower door 275 is in the closed position, end face 273 of primary door 259 is aligned with end face 291 of follower door 275, with a gap existed between end faces 273 and 291, and with latch 333 engaged in receptacle 294 of follower door 275. A coupling member 237 is mounted in mounting hole 295 of follower door 275 (FIGS. 4 and 5). Coupling member 237 includes a first portion 239, a second portion 251, and a third portion 253. Second portion 251 extends perpendicularly to an end of first portion 239 and an end of third portion 253, with first and third portions 239 and 253 parallel to and spaced from each other. A receiving hole 255 is defined in each of first and third portions 239 and 253, with receiving hole 255 of first portion 239 aligned with receiving hole 255 of third portion 253. First portion 239 of coupling member 237 is fixed to top face 277 of follower door 275. Second and third portions 251 and 253 extend through mounting hole 295 into interior space 293 of follower door 275.

Figure 2:
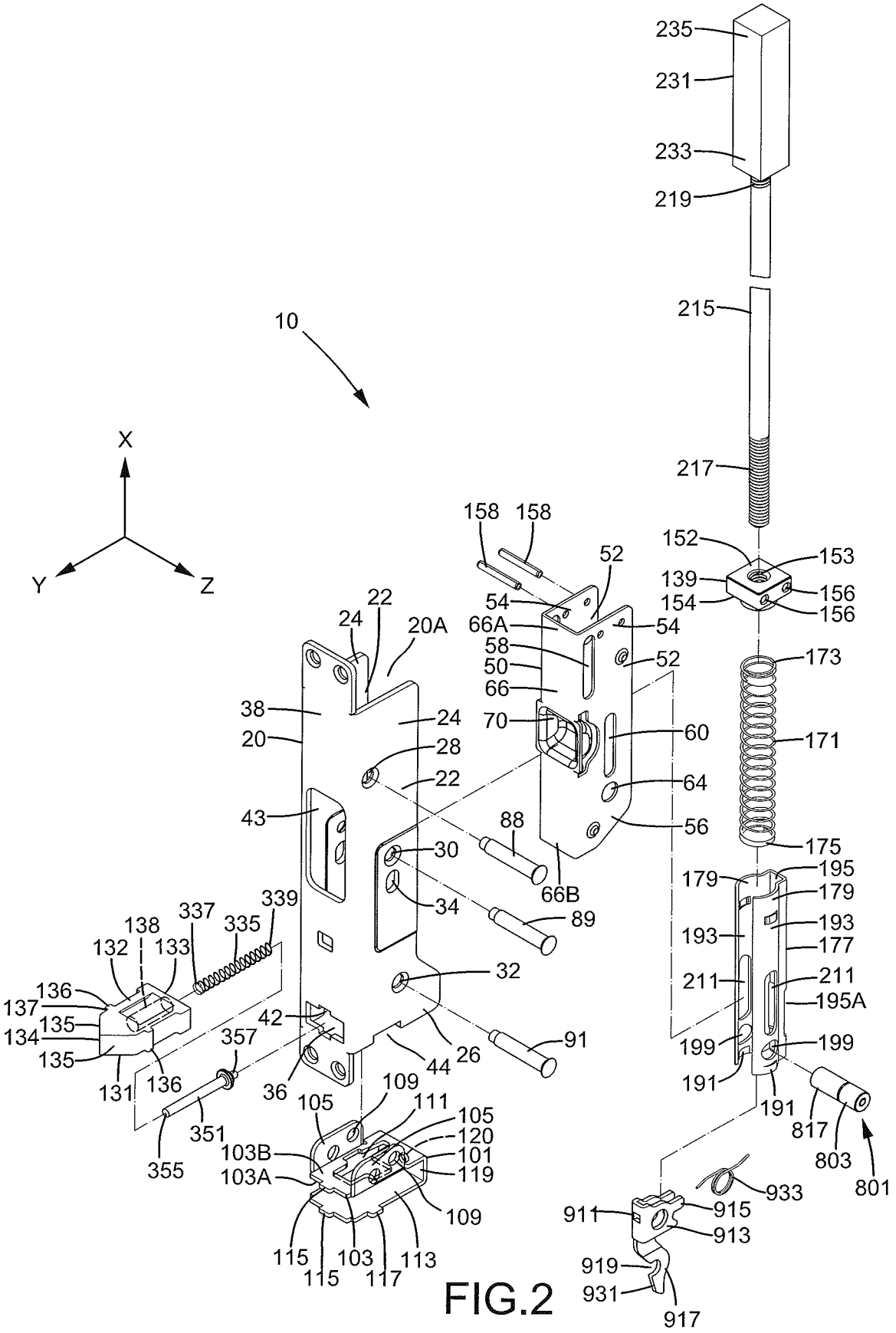
FIG. 2 is an exploded, perspective view of each latch assembly of FIG. 1.

In the form shown, latch assembly 10 is mounted in a location adjacent to top face 277 of follower door 275. Latch assembly 10 includes a base 20 (FIG. 2) having two sidewalls 22 spaced from each other along a third axis Z perpendicular to second axis Y and first axis X and an intermediate wall 38 extending between sidewalls 22. Two sidewalls 22 and intermediate wall 38 of the base 20 together define an activity space 20A which is open. Each sidewall 22 includes a first end 24 and a second end 26 spaced from first end 24 along first axis X. Each sidewall 22 further includes a first engagement hole 28 located adjacent to first end 24, a second engagement hole 30 located between first engagement hole 28 and second end 26, and a third engagement hole 32 located in second end 26. Each sidewall 22 further includes a coupling hole 34 located between second engagement hole 30 and third engagement hole 32 along first axis X and adjacent to second engagement hole 30. The base 20 further includes a slot 36 defined in intermediate wall 38 and adjacent to second end 26 of each sidewall 22. Slot 36 includes two edges spaced along first axis X, with a first engagement groove 42 defined in each edge of first slot 36. A second engagement groove 44 is defined an end face of second end 26 of each sidewall 22. An actuating slot 43 is defined in intermediate wall 38 and between slot 36 and first end 24 of each sidewall 22.

Intermediate wall 38 of base 20 is engaged in engagement hole 297 of follower door 275 (FIGS. 4 and 5), with sidewalls 22 received in interior space 293 of follower door 275. Screws are extended through intermediate wall 38 into end face 291 of follower door 275 to fix base 20 to follower door 275, with first end 24 of each sidewall 22 facing top beam 35 (FIG. 1).

Latch assembly 10 further includes a movable member 50 movably received in activity space 20A of base 20. Movable member 50 includes two lateral walls 52 spaced from each other along a third axis Z perpendicular to first axis X and second axis Y and a connecting portion 66 extending between lateral walls 52. Each lateral wall 52 includes a first end 54 and a second end 56 spaced from first end 54 along first axis X. Each lateral wall 52 further includes a first sliding groove 58 in first end 54 and a second sliding groove 60 between second end 56 and first sliding groove 58 along first axis X. Each lateral wall 52 further includes a mounting hole 64 between second end 56 and second sliding groove 60. Connecting portion 66 includes a first end 66A and a second end 66B spaced from first end 66A along first axis X. Connecting portion 66 further includes an actuating groove 70 between first end 66A and second sliding groove 60 along first axis X. Actuating groove 70 extends along second axis Y and is spaced from first sliding groove 58. Lateral walls 52 of movable member 50 are received between sidewalls 22 of base 20, with first engagement holes 28 of sidewalls 22 aligned with first sliding grooves 58 of lateral walls 52, with second engagement holes 30 of sidewalls 22 aligned with second sliding grooves 60, and with actuating groove 70 aligned with actuating slot 43.

Figure 9:
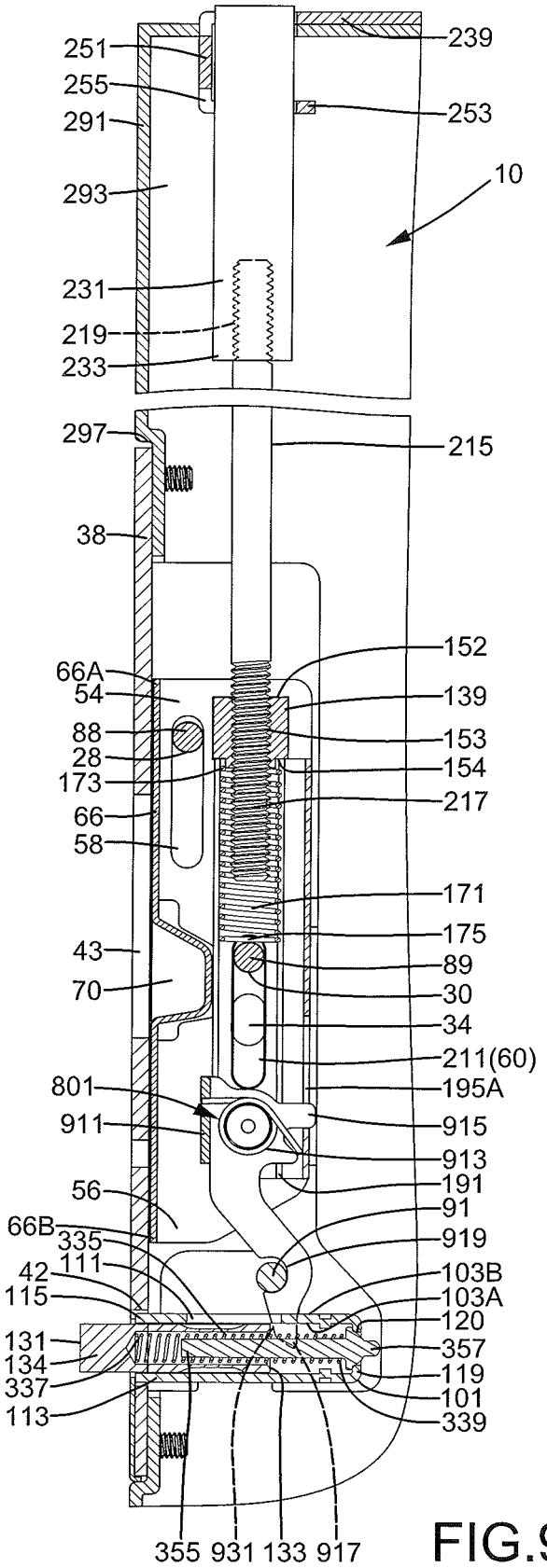
FIG. 9 is a view similar to FIG. 8, with the movable member moved to the disengagement position, and with the positioning member engaged with the third pin.
Figure 10:
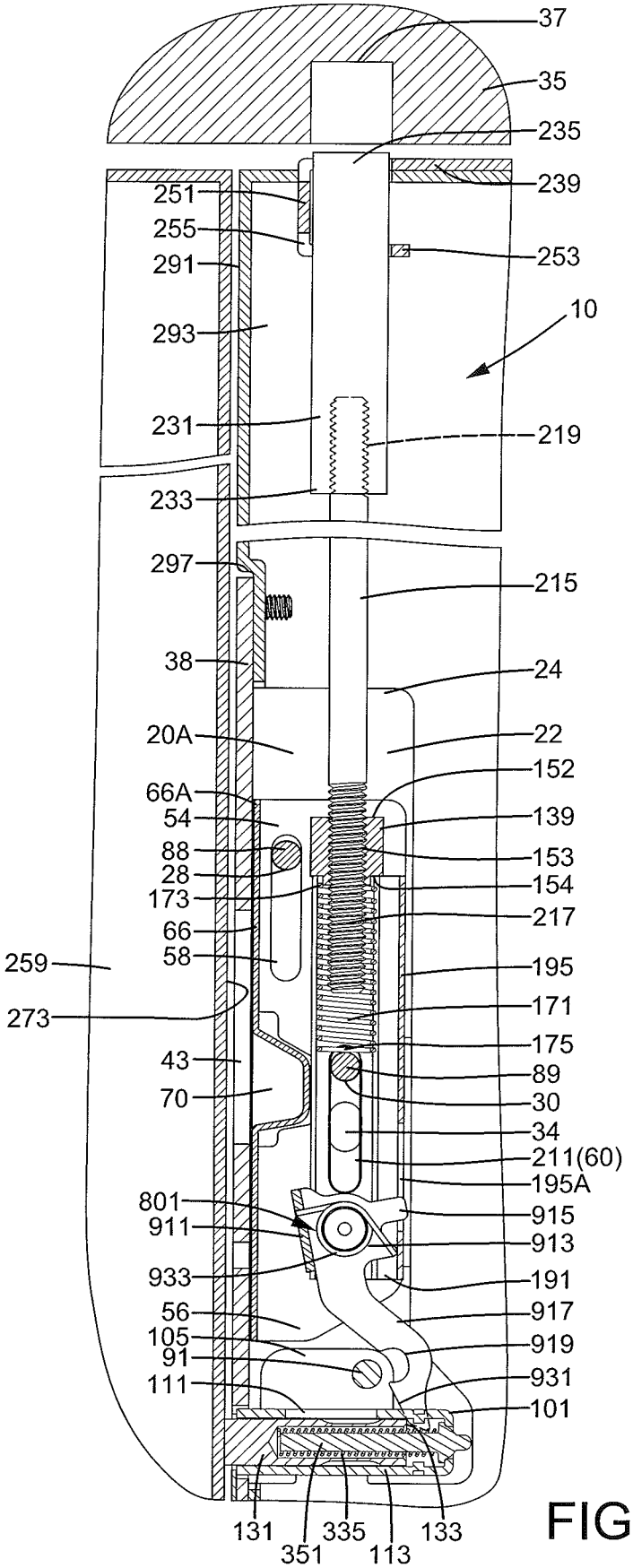
FIG. 10 is a view similar to FIG. 9, with the movable member located in the disengagement position, and with a primary door closed such that the positioning member pivots to a position disengaged from the third pin.

Latch assembly 10 further includes a first pin 88 extending through first engagement holes 28 of sidewalls 22 of base 20 and first sliding grooves 58 of lateral walls 52 of movable member 50. Latch assembly 10 further includes a second pin 89 extending through second engagement holes 30 of sidewalls 22 of base 20 and second sliding grooves 60 of lateral walls 52 of movable member 50. First and second pins 88 and 89 maintain the parallel relationship between connecting portion 66 of movable member 50 and intermediate wall 38 of base 20 and allow movable member 50 to move along first axis X between an engagement position (FIGS. 5 and 11) and a disengagement position (FIGS. 9 and 10). A spacing between first end 66A of connecting portion 66 of movable member 50 in the engagement position and first end 24 of each sidewall 22 of base 20 is smaller than a spacing between first end 66A of connecting portion 66 of movable member 50 in the disengagement position and first end 24 of each sidewall 22 of base 20. However, actuating groove 70 is located in a length of actuating slot 43 along first axis X no matter movable member 50 is in the engagement position or the disengagement position.

Latch assembly 10 further includes a locking block 139 fixed between two lateral walls 52 of movable member 50. Locking block 139 includes a first surface 152 and a second surface 154 spaced from first surface 152 along first axis X. A locking hole 153 extends from first surface 152 through second surface 154 along first axis X and has a thread. Locking block 152 further includes two fixing holes 156 extending from a lateral side through another lateral side of the locking block 152 along third axis Z. Each fixing hole 156 is spaced from locking hole 153. Two fixing pins 158 are provided. Each fixing pin 158 extends through one of two lateral walls 52 of movable member 50 and one of fixing holes 156 into the other lateral wall 52, thereby fixing locking block 139 between two lateral walls 52 of movable member 50. Thus, locking block 139 and movable member 50 move jointly between the engagement position and the disengagement position along first axis X.

A first spring 171 is mounted between locking block 139 and second pin 89. First spring 171 includes a first end 173 abutting against second surface 154 of locking block 139 and a second end 175 abutting against second pin 89. First spring 171 biases locking block 139, moving movable member 50 and locking block 139 to the engagement position together (FIG. 5).

Latch assembly 10 further includes a limiting frame 101 fixed between sidewalls 22 of base 20 and having substantially U-shaped cross sections. Limiting frame 101 includes a first wall 103 and a second wall 113 spaced from first wall 103 along first axis X. Limiting frame 101 further includes a connecting wall 119 extending between first and second walls 103 and 113. First wall 103 includes an inner face 103A and an outer face 103B spaced from inner face 103A along first axis X. A slot 111 extends from inner face 103A through outer face 103B. A positioning hole 120 is defined in connecting wall 119. A first engagement protrusion 115 is formed on a distal edge of each of first and second walls 103 and 113. Each of first and second walls 103 and 113 includes two lateral edges spaced along third axis Z. A second engagement protrusion 117 is formed on each lateral edge of second wall 113. Two wings 105 respectively extend from the lateral edges of first wall 103 along third axis Z, with each wing 105 having a pivot hole 109.

Each first engagement protrusion 115 of limiting frame 101 is engaged with one of first engagement grooves 42 of base 20. Each second engagement protrusion 117 of limiting frame 101 is engaged with one of second engagement grooves 44 of base 20. Thus, first and second walls 103 and 113 of limiting frame 101 are flush with the edges of slot 36. Pivot holes 109 of limiting frame 101 are aligned with third engagement holes 32 of base 20. Latch assembly 10 further includes a third pin 91 extends through each third engagement hole 32 and each pivot hole 109, fixing limiting frame 101 between sidewalls 22 of base 20.

Latch assembly 10 further includes an actuation latch 131 movably received in slot 36 of base 20 along second axis Y. Actuation latch 131 includes a base portion 132 having a first end 133 and a second end 137 spaced from first end 133 along third axis Z. Second end 137 of base portion 132 includes a first end portion 136 and a second end portion 136 spaced from first end portion 136 along third axis Z. A wedge 134 is formed on second end 137 and is located between first and second end portions 136. Wedge 134 includes substantially triangular cross sections and includes two actuating faces 135 meeting at an edge. Actuating faces 135 are located between end portions 136 along third axis Z. A hole 138 extends from first end 133 towards but spaced from second end 137 of actuation latch 131 along second axis Y. Actuation latch 131 is mounted in slot 36 of base 20. Base portion 132 and first and second end portions 136 are located between first and second walls 103 and 113 of limiting frame 101. Actuating latch 131 is movable along second axis Y between a releasing position in which wedge 134 extends out of base 20 (FIG. 5) and a pressing position in which wedge 134 is received in base 20 (FIGS. 10 and 11). When actuation latch 131 is in the releasing position, second end 137 abuts an inner face of intermediate wall 38 of base 20 (FIG. 5).

A guiding rod 351 is mounted between actuation latch 131 and limiting frame 101. Guiding rod 351 includes a first positioning end 355 engaged with hole 138 of actuation latch 131 and a second positioning end 357 engaged with positioning hole 120 of limiting frame 101. Second positioning end 357 has an outer diameter larger than that of first positioning end 355. A second spring 335 is mounted around guiding rod 351 and located between actuation latch 131 and limiting frame 101. Second spring 335 includes a first end 337 abutting against an end wall of hole 138 and a second end 339 abutting against second positioning end 357. Second spring 335 biases actuation latch 131 from the pressing position to the releasing position. Guiding rod 351 avoids distortion of second spring 335 while actuation latch 131 moves from the releasing position to the pressing position and compresses second spring 335.

Latch assembly 10 further includes a restraining member 177 mounted in movable member 50. Restraining member 177 includes two sides 193 spaced from each other along second axis Y. Restraining member 177 further includes a connecting section 195 extending between sides 193. First spring 171 is received in a space defined by sides 193 and connecting section 195 of restraining member 177. Each side 193 includes a first end 179 and a second end 191 spaced from first end 179 along first axis X. Each side 193 further includes a slot 211 between first and second ends 179 and 191. An engagement hole 199 is defined in second end 191 of each side 193, with slot 211 located between first end 179 and engagement hole 199 along axis X. Furthermore, restraining member 177 includes a slot 195A defined in connecting section 195. Sides 193 of restraining member 177 are located between lateral walls 52 of movable member 50, with slots 211 aligned with second sliding grooves 60, and with engagement holes 199 aligned with mounting holes 64. Second pin 89 extends through second engagement holes 30 of base 20, second sliding grooves 60 of movable member 50, and slots 211 of restraining member 177. First end 179 of each side 193 of restraining member 177 has an end face abutting second surface 154 of locking block 139. Second end 191 of each side 193 of restraining member 177 is adjacent to second end 56 of movable member 50. First spring 171 is disposed between two sides 193 of restraining member 177.

A connecting rod 215 is engaged with locking block 139. Specifically, connecting rod 215 includes a first end 217 having an outer thread in threading connection with locking hole 153 of locking block 139. Connecting rod 215 further has a second end 219 to which a latch 231 is engaged. Latch 231 includes an engagement end 233 engaged with second end 219 of connecting rod 215 and a locking end 235. Connecting rod 215 and latch 231 are jointly movable with locking block 139 and movable member 50 along first axis X between the engagement position and the disengagement position. When movable member 50 is in the engagement position, latch 231 is in a latching position (FIG. 5). When movable member 50 is in the disengagement position, latch 231 is in an unlatching position (FIGS. 9 and 10). When latch 231 is in the unlatching position, locking end 235 is received in mounting hole 295 of follower door 275. When latch 231 is in the latching position, locking end 235 of latch 231 extends out of mounting hole 295 of follower door 275. Latch 231 is not aligned with groove 37 when follower door 275 is in the open position. Latch 231 is aligned with groove 37 when follower door 275 is in the closed position (FIGS. 10 and 11).

Figure 3:
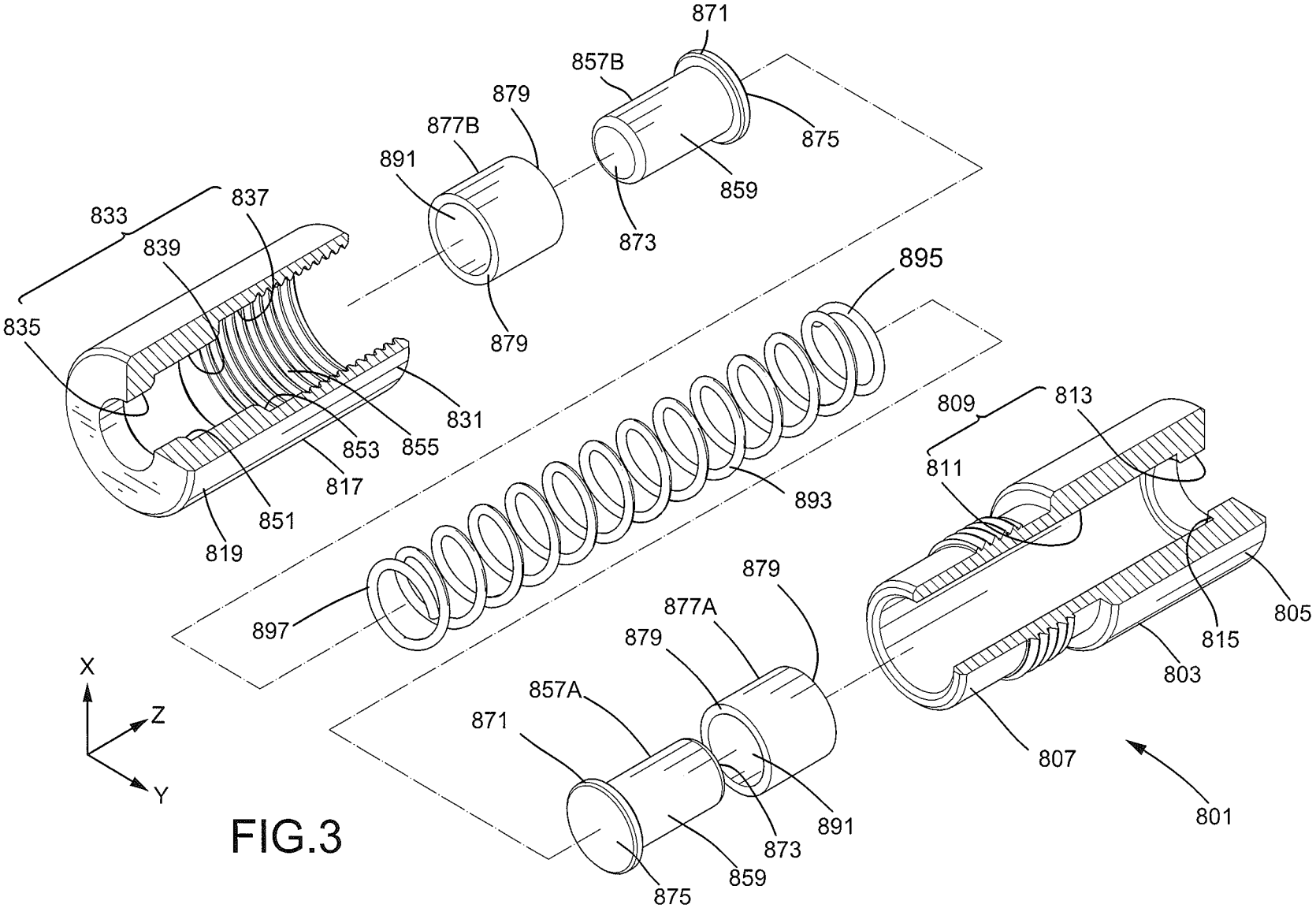
FIG. 3 is an exploded, perspective view of a safety device of the latch assembly of FIG. 2.

Latch assembly 10 further includes a safety device 801 (FIGS. 3 and 7) mounted to movable member 50 and restraining member 177. Safety device 801 includes first and second sleeves 803 and 817 engaged with each other. First sleeve 803 includes a first end 805 and a second end 807 spaced from first end 805 along third axis Z and having a diameter smaller than that of first end 805 and having an outer thread. A receiving hole 809 extends from first end 805 through second end 807. Receiving hole 809 includes a smaller section 813 extending from first end 805 towards but spaced from second end 807 and a larger section 811 extending from second end 807 through smaller section 813 and having a diameter larger than smaller section 813, with a shoulder 815 formed in an intersection of larger and smaller sections 811 and 813. Second sleeve 817 includes a first end 819 and a second end 831 spaced from first end 819 along third axis Z. A mounting hole 833 extends from first end 819 through second end 831. Mounting hole 833 includes a first hole section 835 extending from first end 819 towards but spaced from second end 831, a second hole section 837 extending from second end 831 towards but spaced from first end 819, and an intermediate hole section 839 between first and second hole sections 835 and 837, with a first abutment face 851 formed at an intersection of first hole section 835 and intermediate hole section 839, and with a second abutment face 853 formed at an intersection of intermediate hole section 839 and second hole section 837. Second hole section 837 includes an inner thread 855 spaced from second abutment face 853 along third axis Z.

Figure 7:
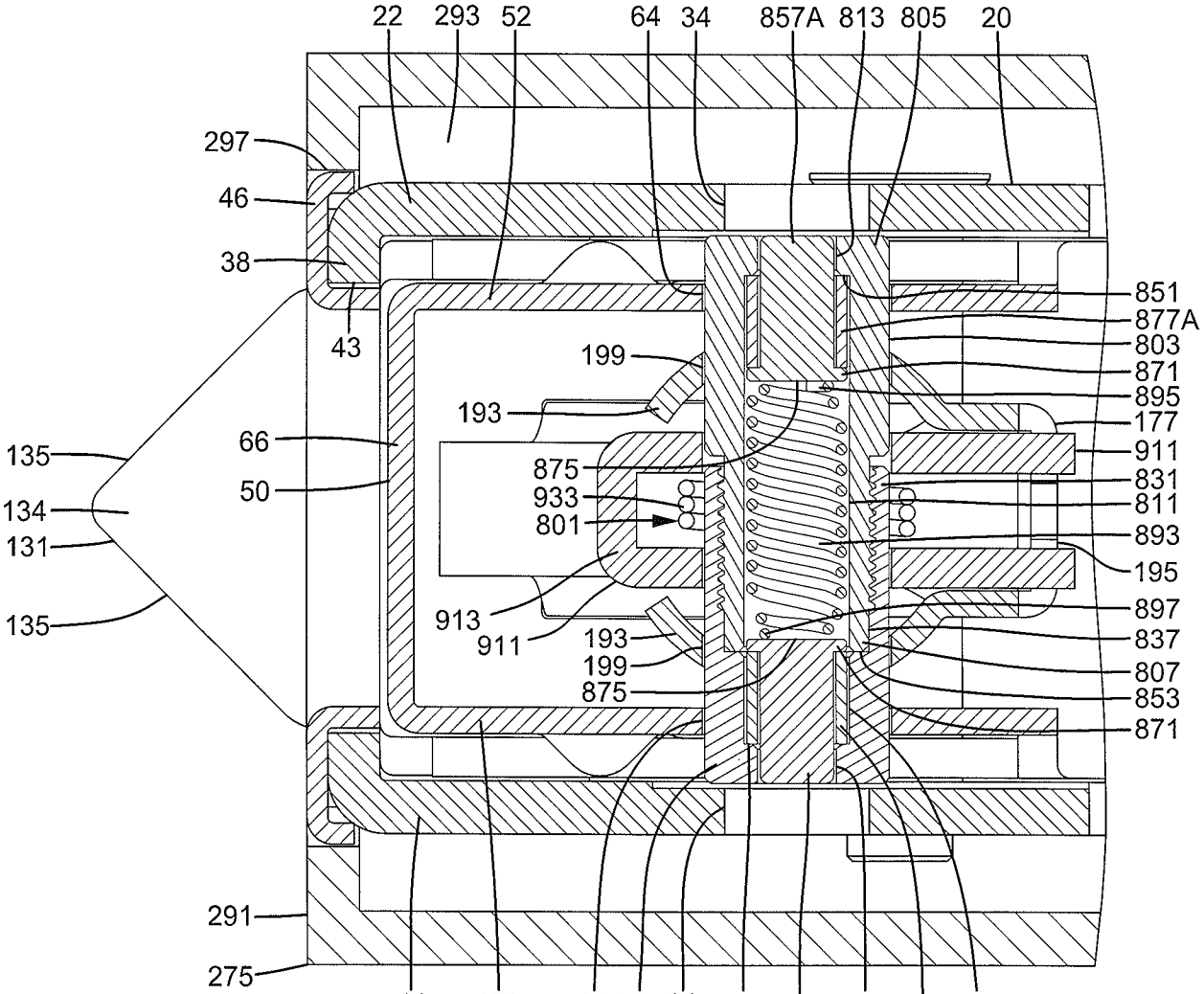
FIG. 7 is a cross sectional view taken along section line 7-7 of FIG. 5.

Second end 807 of first sleeve 803 of safety device 801 is threaded into second hole section 837 of second sleeve 817 and engages with inner thread 855. An end face of second end 807 of first sleeve 803 abuts second abutment face 853 of second sleeve 817 (FIG. 7).

Safety device 801 further includes first and second stops 877A and 877B respectively mounted in first and second sleeves 803 and 817. First and second stops 877A and 877B are made of a material having a melting point lower than first and second sleeves 803 and 817, such as plastic. Each of first and second stops 877A and 877B has two ends 879 spaced from each other along third axis Z and a through-hole 891 extending from an end 879 through the other end 879. First stop 877A has an outer diameter slightly smaller than the inner diameter of larger section 811 of first sleeve 803. First stop 877A is received in larger section 811 of first stop 877A, with an end 879 abutting shoulder 815. Second stop 877B has an outer diameter smaller than the inner diameter of intermediate hole section 839 of second sleeve 817. Second stop 877B is received in intermediate hole section 839 of second sleeve 817, with an end 879 abutting first abutment face 851. A length of second stop 877B along third axis Z is equal to a length of intermediate hole section 839 of second sleeve 817 along third axis Z.

Safety device 801 further includes first and second safety pins 857A and 857B respectively mounted in first and second sleeves 803 and 817. Each of first and second safety pins 857A and 857B has a cylindrical shank 859 and a flange 871 on an end of shank 859 and having an end face 875. Shank 859 further has a distal end 873 away from flange 871.

First safety pin 857A is mounted in receiving hole 809 of first sleeve 803, with shank 859 of first safety pin 857A extending through through-hole 891 of first stop 877A. A length of shank 859 along third axis Z is equal to a sum of a length of first stop 877A and a length of smaller section 813 of receiving hole 809 along third axis Z. An outer diameter of shank 859 of first safety pin 857A is slightly smaller than the inner diameter of smaller section 813 of receiving hole 809 of first sleeve 803 and slightly smaller than through-hole 891 of first stop 877A. An outer diameter of flange 871 of first safety pin 857A is slightly smaller than the inner diameter of larger section 811 of receiving hole 809 of first sleeve 803 but larger than the inner diameter of through-hole 891 of first stop 877A, such that flange 871 of first safety pin 857A abuts an end 879 of first stop 877A distant to shoulder 815. Furthermore, distal end 873 of shank 859 extends through smaller section 813 of first sleeve 803, and an end face of distal end 873 of shank 859 of first safety pin 857A is flush with the end face of first end 805 of first sleeve 803. Second safety pin 857B is mounted in mounting hole 833 of second sleeve 817.

A length of shank 859 of second safety pin 857B along third axis Z is equal to the sum of a length of second stop 877B and a length of first hole section 835 of mounting hole 833 along third axis Z. An outer diameter of shank 859 of second safety pin 857B is slightly smaller than the inner diameter of first hole section 835 of mounting hole 833 of second sleeve 817 and slightly smaller than the inner diameter of through-hole 891 of second stop 877B. An outer diameter of flange 871 of second safety pin 857B is slightly smaller than the inner diameter of second hole section 837 of mounting hole 833 of second sleeve 817 but larger than the inner diameter of through-hole 891 of second stop 877B, such that flange 871 of second safety pin 857B abuts an end 879 of second stop 877B distant to first abutment face 851. Furthermore, distal end 873 of shank 859 of second safety pin 857B extends through first hole section 835 of second sleeve 817, and an end face of distal end 873 of shank 859 of second safety pin 857B is flush with the end face of first end 819 of second sleeve 817.

Safety device 801 further includes a safety spring 893 mounted in larger section 811 of first sleeve 803 and having first and second ends 895 and 897. First end 895 of safety spring 893 presses against end face 875 of first safety pin 857A, and second end 897 of safety spring 893 presses against end face 875 of second safety pin 857B (FIG. 7). Thus, safety spring 893 biases first safety pin 857A towards one of sidewalls 22 of base 20 and biases second safety pin 857B towards the other sidewall 22 of base 20. However, first and second safety pins 857A and 857B are still stopped by first and second stops 877A and 877B, such that distal ends 873 of first and second safety pins 857A and 857B are in retracted positions in first and second sleeves 803 and 817 and, thus, can not extend beyond first and second sleeves 803 and 817 (FIG. 7). Namely, movable member 50 can move along first axis X between the disengagement position (FIG. 9) and the engagement position (FIG. 11).

Figure 12:
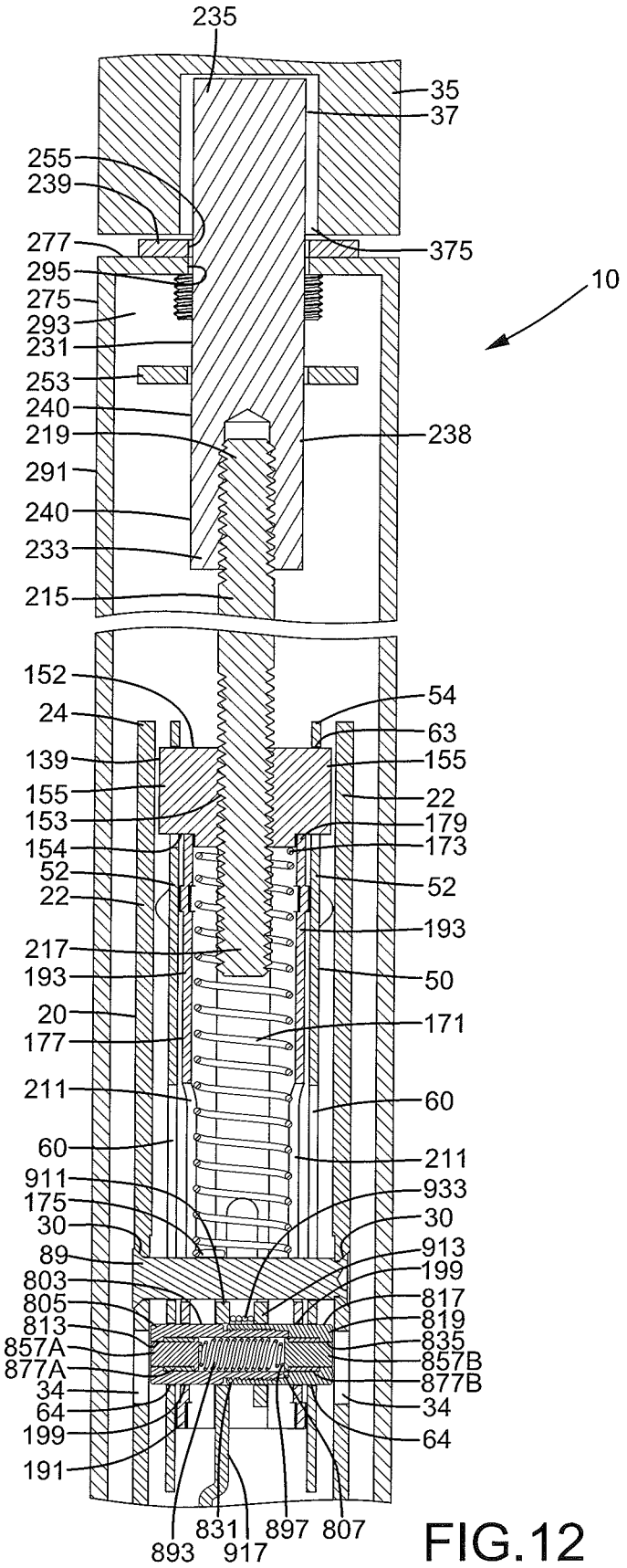
FIG. 12 is a cross sectional view taken along section line 12-12 of FIG. 11.

Safety device 801 is mounted in mounting holes 64 of movable member 50 and engagement holes 199 of restraining member 177 (FIGS. 6 and 7), with first end 805 of first sleeve 803 extending through one of engagement hole 199 of restraining member 177 and one of mounting holes 64 of movable member 50, with first end 819 of second sleeve 817 extending through the other engagement hole 199 of restraining member 177 and the other mounting hole 64 of movable member 50, and with safety device 801 located between sidewalls 22 of base 20. Movable member 50 and restraining member 177 are connected together by safety device 801 and are jointly movable along first axis X between the disengagement position (FIG. 9) and the engagement position (FIG. 11). When movable member 50 is in the engagement position, first and second safety pins 857A and 857B of safety device 801 are aligned with coupling holes 34 (FIGS. 5 and 12). When movable member 50 is in the disengagement position, first and second safety pins 857A and 857B of safety device 801 are misaligned from coupling holes 34 (FIG. 10).

Latch assembly 10 further includes a positioning member 911 pivotably connected to safety device 801. Positioning member 911 includes a pivotal portion 913 having a circular hole and a protrusion 915 extending from a side of pivotal portion 913. Positioning member 911 further includes an engagement arm 917 extending from a side of pivotal portion 913 and spaced from protrusion 915. Engagement arm 917 includes an engagement notch 919 and a slant face 931 adjacent to but spaced from engagement notch 919. Pivotal portion 913 of positioning member 911 is mounted around an outer periphery of each of first and second sleeves 803 and 817 of safety device 801. Protrusion 915 is received in slot 195A of restraining member 177.

Figure 6:
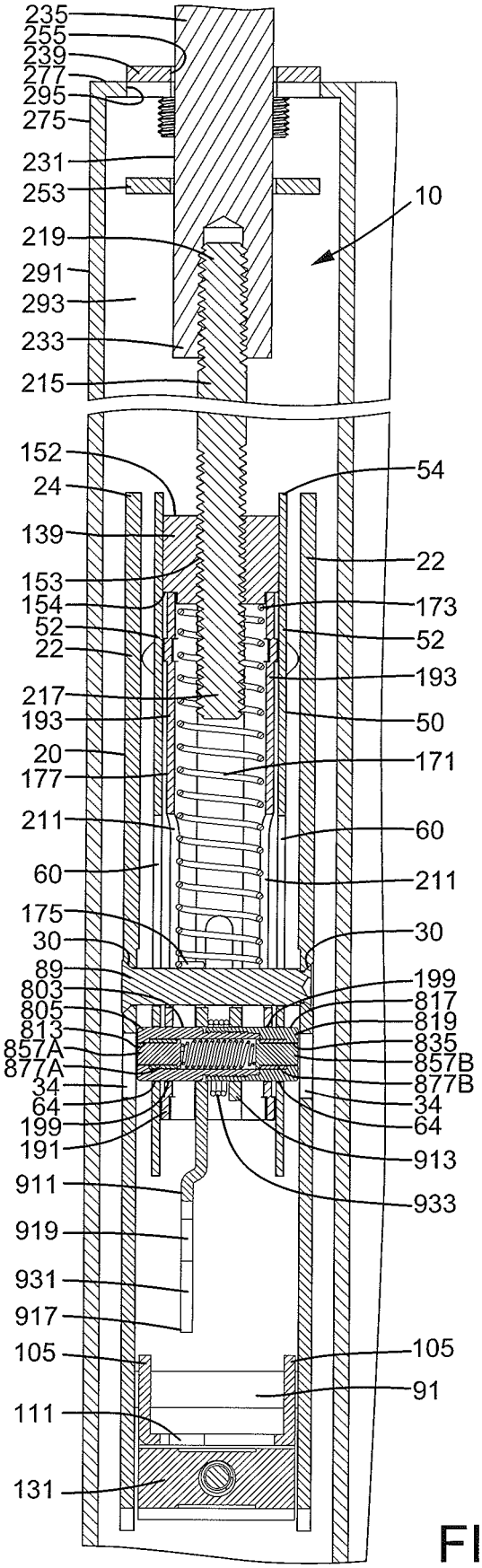
FIG. 6 is a cross sectional view taken along section line 6-6 of FIG. 4.

Now that the basic construction of latch assembly 10 has been explained, the operation and some of the advantages of latch assembly 10 can be set forth and appreciated. In particular, for the sake of explanation, it will be assumed that primary door 259 is in an open position and the follower door 275 is in the open position (FIGS. 5 and 6). Latch 231 is not aligned with groove 37 of top beam 35 of door frame 31. End face 273 of primary door 259 is not aligned with end face 291 of follower door 275. Movable member 50 is in the engagement position. Latch 231 is in the latching position. Actuation latch 131 is in the releasing position (FIGS. 5 and 6). Positioning member 911 is in an initial position in which protrusion 915 abuts against an inner wall of slot 195A of restraining member 177.

Figure 8:
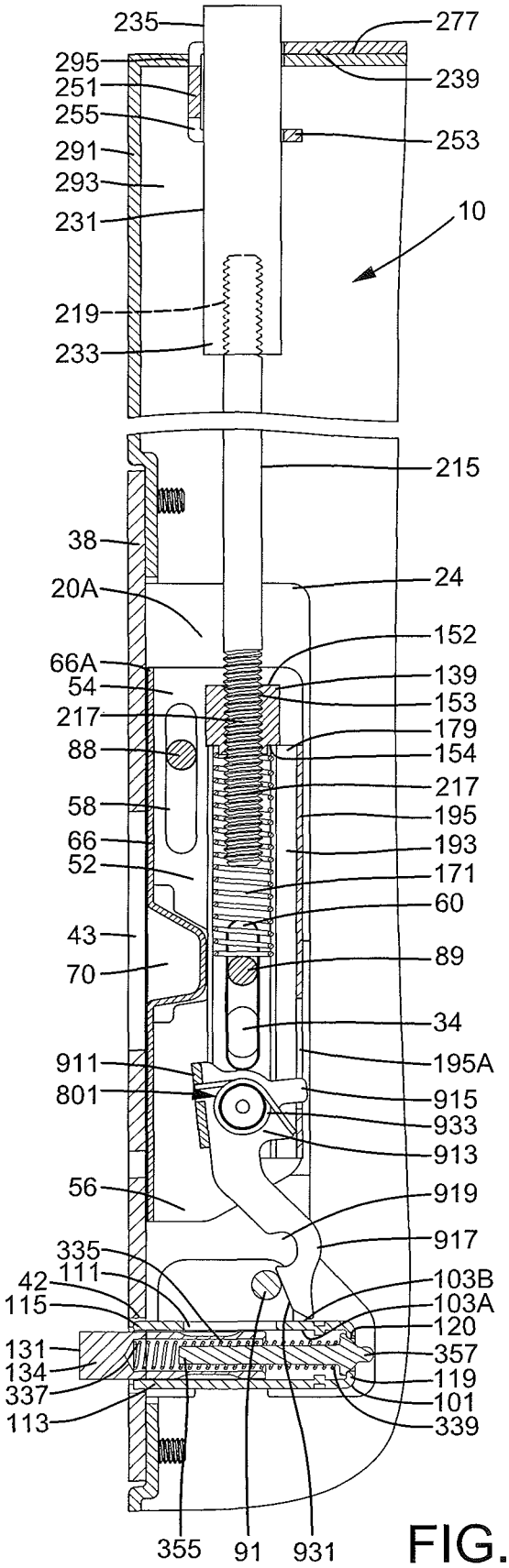
FIG. 8 is a view similar to FIG. 5, with a movable member moved to a position near a disengagement position, and with a positioning member pressed by a third pin to pivot.

In this state, a user can extend his or her finger into actuating groove 70 of movable member 50 through actuating slot 43 of base 20 and applies a force along first axis X in a direction toward second ends 26 of sidewalls 22 of base 20, urging movable member 50 to compress first spring 171 and to move together with restraining member 177, locking block 139, connecting rod 215, latch 231 (with latch 231 moving from the latching position to unlatching position), positioning member 911, and torsion spring 933 from the engagement position (FIG. 5) to the disengagement position (FIG. 9). When movable member 50 is near the disengagement position (FIG. 8), slant face 931 of engagement arm 917 of positioning member 911 is pressed by third pin 91 to pivot about a central, pivotal axis defined by safety device 801, and torsion spring 933 pivots from the initial position.

When movable member 50 reaches the disengagement position, latch 231 moves to the retracted, unlatching position (FIG. 9). Positioning member 911 is biased by torsion spring 933, such that engagement groove 919 engages with third pin 91. Furthermore, positioning member 911 is restrained by third pin 91 and, thus, cannot move along first axis X. Thus, safety device 901, movable member 50, restraining member 177, locking block 139, connecting rod 215, and latch 231 also cannot move along first axis X. As a result, movable member 50 is positioned in the disengagement position, and latch 231 is positioned in the unlatching position. Furthermore, a distal end of engagement arm 917 of positioning member 911 extends through slot 111 of limiting frame 101 to a position adjacent to first end 133 of actuation latch 131 (FIG. 9).

When follower door 275 pivots from the open position to closed position about first axis X, with follower door 275 gradually approaching the closed position, actuating face 135 of actuation latch 131 is pressed by primary door 259, actuation latch 131 compresses second spring 335 and moves from the releasing position toward the toward pressing position along second axis Y, and first end 133 of actuation latch 131 actuates engagement arm 917 of positioning member 911. When follower door 275 moves further toward the closed position, latch 231 is aligned with groove 37 of top beam 35, actuation latch 131 actuates engagement receptacle 919 of positioning member 911 to disengage from third pin 91, and first spring 171 biases locking block 139, causing movable member 50, restraining member 177, positioning member 911, torsion spring 933, and safety device 801 to move jointly along first axis X from the disengagement position to the engagement position. At the same time, connecting rod 215 moves together with locking block 139 to move latch 231 along first axis X from the unlatching position (FIG. 10) to the latching position (FIGS. 11 and 12) in which latch 231 enters and engages with groove 37.

When follower door 275 is located in the closed position (FIG. 11) and primary door 259 is closed, latch 333 of door lock 319 is engaged in receptacle 294 of follower door 275, and actuating slot 43 of base 20 is covered by end face 273 of primary door 259, such that movable member 50 can not be moved to the disengagement position via actuating groove 70. Furthermore, it is impossible to move latch 231 to the unlatching position via movable member 50. Thus, primary door 259 and follower door 275 are positioned in the closed position.

When it is desired to move latch 231 from the latching position to the unlatching position, handle 331 of door lock 319 must be pivoted to retract latch 333, and primary door 259 must be moved to a position in which end face 273 of primary door 259 is spaced from end face 291 of follower door 275, thereby exposing actuating slot 43 of base 20. Actuation latch 131 is moved from the pressing position to the releasing position under the action of second spring 335. Thus, a user can extend his or her finger into actuation groove 70 to move movable member 50 from the engagement position to the disengagement position along first axis X, moving latch 231 from the latching position to the unlatching position. Then, follower door 275 can be moved from the closed position to the open position.

Figure 13:
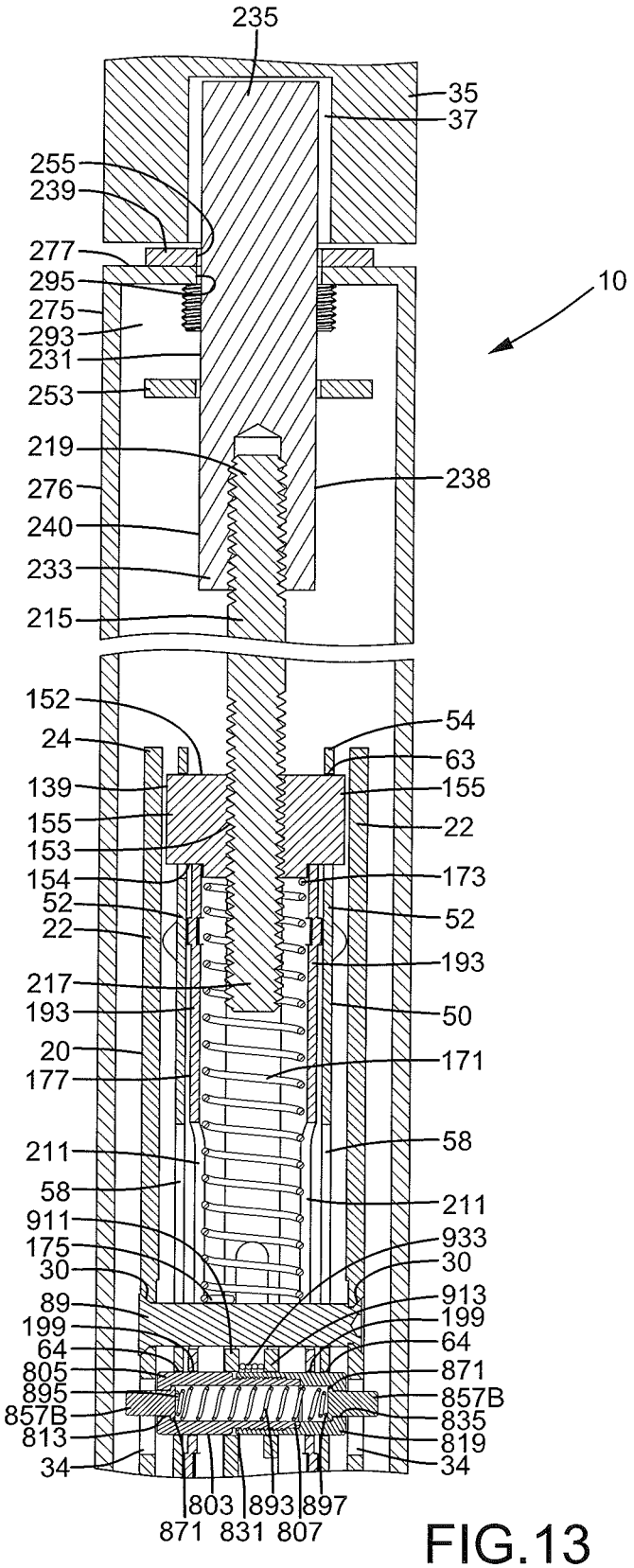
FIG. 13 is a view similar to FIG. 10, with first and second safety pins of the safety device moved to an extended position during a fire.

With reference to FIG. 13, in a case that a fire occurs while both of follower door 275 and primary door 259 are in their closed positions in which end face 273 of primary door 259 is aligned with end face 273 of follower door 275 and in which latch 231 is in the latching position engaged with groove 37, first and second stops 877A and 877B of safety device 801 made of plastic melt due to the heat of the fire. First safety pin 857A is moved from the retracted position to an extended position into one of coupling holes 34 of base 20 under the action of safety spring 893. Likewise, second safety pin 857B is moved from the retracted position to an extended position into the other coupling hole 34 of base 20 under the action of safety spring 893. Thus, movable member 50 is retained in the engagement position, retaining latch 231 in the latching position. Thus, primary door 259 can not be opened during the fire even if latch 333 of door lock 319 is retracted, avoiding spread of the fire by avoiding opening of double door 257.

Follower door 275 can pivot to the closed position only when latch 231 is in the unlatching position. When follower door 275 is in the closed position and primary door 259 is also closed, latch 231 can be moved to the latching position by abutting actuation latch 131 against positioning member 911 to thereby pivot positioning member 911. Namely, when primary door 259 is closed, follower door 275 will be locked (and, thus, cannot pivot from the closed position to the unclosed position), assuring locking of double door 257 in the closed position. Thus, undesired easy opening of the follower door 275 is prevented even if a user forgets to lock follower door 275.

Through use of positioning member 911, latch assembly 10 can position retract latch 231 in the unlatching position retracted into follower door 275, such that latch assembly 10 can be installed in not only a position adjacent to top face 277 of follower door 275 to serve as an upper latch assembly (the latch assembly 10 adjacent to top face 277 in FIG. 1) but also in a position adjacent to bottom face 279 of follower door 275 to serve as a bottom latch assembly (the latch assembly 10 adjacent to bottom face 279 in FIG. 1).

Now that the basic teachings of the present invention have been explained, many extensions and variations will be obvious to one having ordinary skill in the art. For example, latch assembly 10 does not have to include safety device 801 and restraining member 177. In this case, positioning member 911 is pivotably connected to movable member 50 and restraining member 177 by a pin around which torsion spring 933 is mounted. First spring 171, when compressed, could distort if restraining member 177 is not included. However, such a problem can be resolved by minimizing the spacing between two lateral walls 52 of movable member 50 along third axis Z or by increasing the outer diameter of first spring 171.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch assembly comprising:

a base including an activity space, wherein the base further includes a first engagement hole, a second engagement hole, and a third engagement hole, and wherein the base further includes an actuating slot;

a first pin extending through the first engagement hole of the base;

a second pin extending through the second engagement hole of the base;

a third pin extending through the third engagement hole of the base;

a movable member slideably received in the activity space of the base, wherein the movable member includes a first sliding groove slideably receiving the first pin and a second sliding groove slideably receiving the second pin, wherein the movable member is movable between an engagement position and a disengagement position spaced from the engagement position along a first axis, wherein the movable member further includes an actuating groove received in the actuating slot and configured to move the movable member between the engagement position and the disengagement position;

a latch jointly movable with the movable member, wherein the latch is movable between a latching position and an unlatching position spaced from the latching position along the first axis, wherein the latch is in the unlatching position when the movable member is in the disengagement position, and wherein the latch is in the latching position when the movable member is in the engagement position;

a limiting frame fixed on the base and located adjacent to the third pin;

an actuation latch movably received in the limiting frame, wherein the actuation latch is movable between a releasing position and a pressing position along a second axis perpendicular to the first axis;

a positioning member pivotably connected the movable member, wherein the positioning member includes an engagement arm, wherein the positioning member disengages from the third pin and moves jointly with the movable member and the latch along the first axis when the movable member moves between the engagement position and the disengagement position, and the positioning member is pivotable relative to the movable member about a third axis perpendicular to the first and second axes; and a first sprint mounted in the base and configured to bias the movable member towards the engagement position, wherein when the movable member is in the engagement position, the positioning member is spaced from the third pin along the first axis, wherein when the movable member is in the disengagement position and the actuation latch is in the releasing position, the engagement arm of the positioning member engages with the third pin, such that the movable member is located in the disengagement position and such that the latch is retained in the unlatching position, preventing the positioning member from moving along the first axis, and wherein when the actuation latch moves from the releasing position to the pressing position while the engagement arm of the positioning member engages with the third pin, the actuation latch pushes the positioning member to pivot about the third axis to thereby disengage the engagement arm from the third pin, such that the movable member moves to the engagement position and such that the latch moves to the latching position while the latch, the movable member, and the positioning member move jointly along the first axis under an action of the first spring.

2. The latch assembly as claimed in claim 1, wherein the engagement arm of the positioning member further includes a slant face corresponding to the third pin and an engagement notch adjacent to the slant face, wherein when the movable member moves from the engagement position to the disengagement position, the third pin presses against the slant face of the positioning member, such that the positioning member pivots relative to the movable member, and wherein when the movable member is in the disengagement position, the engagement notch of the engagement arm of the positioning member engages with the third pin.

3. The latch assembly as claimed in claim 1, further comprising:

a safety device jointly moveable with the movable member, wherein the safety device includes a first sleeve and a second sleeve coupled to the first sleeve, wherein the first sleeve includes a receiving hole, wherein the safety device further includes a first stop mounted in the receiving hole of the safety device and a first safety pin coupled with the first stop, wherein the safety device further includes a spring mounted in the receiving hole and biasing the first safety pin, wherein the base further includes a coupling hole intercommunicated with the activity space, wherein the positioning member further includes a pivotal portion pivotably connected to the safety device, wherein the engagement arm of the positioning member extends from a side of the pivotal portion of the positioning member, wherein when the movable member is in the disengagement position, the first safety pin of the safety device is misaligned from the coupling hole of the base, wherein when the movable member is in the engagement position, the first safety pin of the safety device is aligned with the coupling hole of the base, wherein when the first safety pin is aligned with the coupling hole of the base and does not melt, the first safety pin does not engage with the coupling hole of the base, and the movable member is movable between the disengagement position and the engagement position, and wherein when the first safety pin is aligned with the coupling hole of the base and melts, the first safety pin engages with the coupling hole of the base, and the movable member is prevented from moving from the disengagement position to the engagement position.

4. The latch assembly as claimed in claim 3, further comprising:

a restraining member jointly movable with the movable member, wherein the restraining member includes a slot, wherein the positioning member further includes a protrusion extending from the pivotal portion and spaced from the engagement arm;

and a torsion spring mounted around the safety device, wherein the torsion spring biases the positioning member to an initial position, wherein the first spring is mounted in the restraining member, and wherein the first spring includes an end abutting the second pin and biases the movable member toward the engagement position, wherein when the positioning member is in the initial position, the protrusion of the positioning member abuts an inner wall of the slot of the restraining member, and wherein when the movable member moves from the engagement position to the disengagement position, the third pin presses against the engagement arm of the positioning member, such that the positioning member twists the torsion spring from the initial position.

* * * * *